US011633970B2

(12) United States Patent
McNestry et al.

(10) Patent No.: US 11,633,970 B2
(45) Date of Patent: Apr. 25, 2023

(54) TAPE SUPPORT ARRANGEMENT

(71) Applicant: Videojet Technologies Inc., Wood Dale, IL (US)

(72) Inventors: Martin McNestry, Heanor (GB); Steven John Buckby, Bleasby (GB)

( * ) Notice: Subject to any disclaimer, the term of this patent is extended or adjusted under 35 U.S.C. 154(b) by 1488 days.

(21) Appl. No.: 15/748,696

(22) PCT Filed: Jul. 29, 2016

(86) PCT No.: PCT/GB2016/052333
§ 371 (c)(1),
(2) Date: Jan. 30, 2018

(87) PCT Pub. No.: WO2017/021703
PCT Pub. Date: Feb. 9, 2017

(65) Prior Publication Data

US 2019/0001722 A1 Jan. 3, 2019

(30) Foreign Application Priority Data

Jul. 31, 2015 (GB) ..... 1513537

(51) Int. Cl.

| | |
|---|---|
| ***B41J 33/12*** | (2006.01) |
| ***B41J 17/22*** | (2006.01) |
| ***B41J 33/00*** | (2006.01) |
| ***B41J 17/24*** | (2006.01) |
| ***B41J 35/08*** | (2006.01) |
| ***B65H 75/28*** | (2006.01) |

(52) U.S. Cl.
CPC ..... *B41J 33/12* (2013.01); *B41J 17/22* (2013.01); *B41J 17/24* (2013.01); *B41J 33/003* (2013.01); *B41J 35/08* (2013.01); *B65H 75/285* (2013.01); *B41J 33/006* (2013.01)

(58) Field of Classification Search
CPC ..... B41J 17/22; B41J 17/24; B41J 33/003; B41J 33/006; B41J 33/12; B41J 35/08; B65H 75/18; B65H 75/28; B65H 75/285
See application file for complete search history.

(56) References Cited

U.S. PATENT DOCUMENTS 2,936,883 A * 5/1960 Eichacker ..... B41J 33/003 206/402
5,597,248 A 1/1997 Burgin
6,042,039 A 3/2000 Furuya et al.
(Continued)

FOREIGN PATENT DOCUMENTS

EP 0028873 A2 * 5/1981 ..... B41J 33/52
EP 0268639 A1 6/1988
EP 0599789 A1 6/1994
(Continued)

*Primary Examiner* — Jill E Culler
(74) *Attorney, Agent, or Firm* — Wolter Van Dyke Davis, PLLC; Robert L. Wolter

(57) ABSTRACT

A tape support arrangement comprises a tape take up core (220) suitable for supporting a tape; and a tape supply core (210) suitable for supporting a tape (230). The supply core (210) comprises an inner surface (212), the inner surface defining an internal volume (240) of the supply core and being configured for engagement with a tape drive support. The take up core (220) is sized and shaped such that it can be located in the internal volume (240) of the supply core (210). Refer to FIG. 2.

17 Claims, 9 Drawing Sheets

(56) References Cited

U.S. PATENT DOCUMENTS

| | | | |
|---|---|---|---|
| 6,164,203 | A | 12/2000 | Keller |
| 2012/0280077 | A1 | 11/2012 | Deonarine |

FOREIGN PATENT DOCUMENTS

| | | | |
|---|---|---|---|
| EP | 2315314 | A1 | 4/2011 |
| GB | 1288859 | A | 9/1972 |
| JP | S6216165 | A | 1/1987 |
| JP | S6282870 | A | 4/1987 |
| JP | H03169578 | A | 7/1991 |
| JP | H09109498 | A | 4/1997 |
| JP | 2000108472 | A | 4/2000 |
| JP | 2003154719 | A | 5/2003 |
| JP | 2003211764 | A | 7/2003 |
| WO | 2003072366 | A1 | 9/2003 |

* cited by examiner

TAPE SUPPORT ARRANGEMENT

This invention relates to a tape support arrangement. In particular, the tape supported by the tape support arrangement may be printer ribbon such that the tape support arrangement may form part of a tape drive of a printing apparatus. Furthermore, the invention relates to a spool of tape which may be utilised with a tape drive or printing apparatus.

A tape drive is an apparatus which is configured to drive tape along a desired tape path. It is common that the tape path extends between a supply spool and a take-up spool such that the tape drive drives the tape from the supply spool to the take-up spool. Tape is usually pre-wound onto the supply spool and the tape drive winds the tape along the tape path and onto the take-up spool. The pre-wound supply spool and take-up spool (or more particularly a core of the take-up spool) are commonly provided as a consumable for the tape drive in the form of a tape support arrangement.

A printing apparatus may include a tape drive. For example, a known type of printing apparatus is a thermal transfer printer, in which a tape, which is normally referred to as a print ribbon, is used to transport ink. In particular, the print ribbon may carry ink on it. In use, a tape drive of the printing apparatus transports the print ribbon from a supply spool to a take-up spool via a print head. The print head interacts with the print ribbon so as to cause the ink on the print ribbon to be transferred from the print ribbon onto a target substrate—for example paper, cardboard, or a flexible film.

In one known type of transfer printer the ink may be carried on a first side of the print ribbon and the print head contacts the underside of the print ribbon so as to cause the ink to be transferred from the print ribbon onto the target substrate.

Printers of this type are used in many applications. Industrial printing applications include thermal transfer label printers and thermal transfer coders which print directly onto a substrate such as packaging materials manufactured from flexible film or card. In addition, such printers may form part of a labelling machine which prints onto a label which is subsequently dispensed and applied by the labelling machine onto a target article.

In light of the comments made above, it is common for an ink ribbon to be delivered to an end user of a printing apparatus as a consumable in the form of a tape support arrangement including a roll wound onto a core. The end user of a printing apparatus of the type previously discussed pushes the core of the wound ink ribbon onto a spool support, pulls a free end of a roll of ink ribbon wound onto the core to release a length of ribbon, and then fixes the free end of the tape to a take-up spool core (which also forms part of the tape support apparatus) and mounts the take up spool core onto a further spool support (the take up spool support). The print apparatus usually includes a transport means for driving at least one of the two spools so as to unwind ribbon from one spool (the supply spool) and to take up ribbon on the other spool (take-up spool).

Known tape support arrangements are relatively heavy and space consuming. The additional weight and space occupied by the known tape support arrangements means that known tape support arrangements are relatively expensive to store and transport. It is an object of the present invent to provide a tape support arrangement which more easy to store and/or transport.

It is common for spools (i.e. a core with or without tape wound onto it) used in tape drives to be such that they can be mounted to a spool support in one of several relative orientations between the spool support and the supported spool. In some applications this may be disadvantageous because it may be beneficial for a spool to be supported by a spool support in a particular orientation. It is an object of the present invention to provide an alternative tape spool which prevents the spool from being mounted to a spool support in an incorrect relative orientation.

Some known tape drives are particularly concerned with accurately controlling the position of the print ribbon and accurately controlling the tension within the print ribbon.

The applicant has realised that there is a market for a different type of printing apparatus. In particular, whilst the majority of development in the state of the art of tape drives and printing apparatus has been directed towards developing more accurate/more efficient apparatus, there is a market for the development of a tape drive which provides an alternative to the present tape drives and printing apparatus which is low cost.

The present invention seeks to provide such an alternative tape drive or printing apparatus which is of relatively low cost. In addition, the present invention attempts to provide corresponding alternative methods of operation and an alternative spool for use with such tape drives and print apparatus.

According to a first aspect of the invention there is provided a tape support arrangement, the arrangement comprising: a tape take up core suitable for supporting a tape; and a tape supply core suitable for supporting a tape, the supply core comprising an inner surface, the inner surface defining an internal volume of the supply core and being configured for engagement with a tape drive support, and wherein the take up core is sized and shaped such that it can be located in the internal volume of the supply core.

It will be appreciated that, for brevity, the phrases "supply core" and "take up core" may be used in place of "tape supply core" and "tape take up core" respectively.

It will be appreciated that when the take up core is located within the internal volume of the supply core, the overall space required to store the assembly is reduced. For example, if the take up core were not locatable within the internal volume of the supply core, the take up core would need to be stored external to the supply core, and so require additional space. By storing the take up core within otherwise empty space already enclosed by the supply core, in particular within the internal volume of the supply core, the overall space required to store the assembly is reduced. This provides the advantage that a greater number of assemblies may be stored within a given space. This is particularly advantageous in situations where a large number of assemblies are in storage; such as, for example, during transportation or warehouse storage. A reduction in the amount of space required for storage/transportation may result in a reduction in the cost of storage/transportation of a large number of tape support assemblies.

The greatest volume of space will be saved when the take up core is fully located within the internal volume of the supply core. However, the take up core may be located within the internal volume of the supply core such that a part of the take up core is located within the supply core, and such that a part of the take up core protrudes from the supply core. In such case, the volume, of space saved is equal to the volume of the take up core which is located within the internal volume.

The take up core may comprise an outer surface and the take up core may be locatable such that the outer surface of the take up core is enclosed by the inner surface of the supply core.

The take up core may be locatable such that the take up core is fully located within the internal volume of the supply core.

The supply core may have a first end and a second end, and the inner surface of the supply core may extend from the first end to the second end such that the internal volume of the supply core extends from the first end to the second end.

The supply core may be generally annular such that the inner surface and internal volume are generally cylindrical.

The take up core may be generally annular and the take up core may comprise an outer surface, such that the outer surface of the take up spool is generally cylindrical.

The arrangement may further comprise a tape.

The tape may comprise a first end, and the first end of the tape may be supported by the supply core. For example, the first end of the tape may be wound onto the supply core such that it is held in place by friction. Alternatively, the tape may be attached to the supply core by adhesive, or the tape may be clamped to the supply core.

The tape may be wound upon the supply core to form a supply spool of tape.

The tape may comprise a second end, and the second end may be supported by the take up core. For example, the second end of the tape may be wound onto the take up core such that it is held in place by friction. Alternatively, the tape may be attached to the take up core by adhesive, or the tape may be clamped to the take up core.

The tape may be a print ribbon carrying ink. For example, the tape may be impregnated with a dye. The tape may comprise portions containing dyes of different colours. The dye may be transferrable between the ribbon and a substrate.

The supply core may have a height and the take up core have a height, and the height of the supply core may be substantially the same as the height of the take up core.

The arrangement may, be configured for use within a printer. The arrangement may be for use within a thermal transfer printer.

According to a second aspect of the invention there is provided a method of producing a tape support arrangement, the arrangement comprising: a tape; a tape take up core suitable for supporting a tape; and a tape supply core suitable for supporting a tape and the tape supply core comprising an inner surface, the inner surface defining an internal volume of the tape supply core and being configured for engagement with a tape drive support, wherein the method comprises: a) winding the tape onto the tape supply core to form a spool of tape, and b) placing the take up core within the internal volume of the tape supply core.

The method may further comprise arranging a second tape support arrangement so that is adjacent to a first tape support arrangement.

The method may further comprise arranging first and second tape support arrangements such that the supply core of the first arrangement is concentric to the supply core of the second arrangement. For example, the first and second arrangements may be arranged such that the first arrangement is stacked on top of the second arrangement, or vice versa.

The method may further comprise arranging the first and second arrangements within a packaging.

According to a third aspect of the invention there is provided a method of packing a plurality of tape support arrangements, the method comprising producing a plurality of tape support arrangements in accordance with the method of the second aspect of the invention, stacking the plurality of tape support arrangements in an end-to-end fashion, and packing the plurality of tape support arrangements so that they are contained within a packing tube.

The packing tube may be a mailing or postal tube.

According to a fourth aspect of the invention there is provided a package comprising a plurality of tape support arrangements according to the first aspect of the invention, wherein the said plurality of tape support arrangements are stacked in an end-to-end fashion with the take up core of each of said plurality of tape support arrangements being located in the internal volume of the respective supply core, and wherein the plurality of tape support arrangements are contained within a packing tube.

The packing tube may be a mailing or postal tube.

The aspects of the invention which relate to packing a plurality of tape support arrangements according to the present invention in a packing tube may be beneficial in certain applications because packing a plurality of tape support arrangements in this way is more efficient in terms of space, weight and cost as compared to ways of packing known tape support arrangements.

According to a fifth aspect of the invention there is provided a tape support arrangement for supporting a tape, the arrangement comprising: a tape, a tape take up core suitable for supporting a tape; and a tape supply core upon which a spool of tape is wound, the tape supply core comprising an inner surface, the inner surface defining an internal volume of the tape supply core and being configured for engagement with a tape drive support, and wherein the take up core is located in the internal volume of the tape supply core.

According to a sixth aspect of the invention, there is provided a first arrangement according to the fifth aspect of the present invention, and a second arrangement according to the fifth aspect of the present invention adjacent the first arrangement; and wherein the first and second arrangements are arranged within a packaging. For example, the first arrangement may be located adjacent the second arrangement such that a portion of the first arrangement is in contact with the second arrangement. The first arrangement may be located adjacent the second arrangement such that the circumference of the first arrangement is in contact with the circumference of the second arrangement. The plurality of arrangements may be arranged within a packaging such as a crate or a box.

The plurality of arrangements may be arranged such that the supply core of the first arrangement is concentric to the supply core of the second arrangement. For example, the first and second arrangements may be arranged such that the first arrangement is stacked on top of the second arrangement, or vice versa.

According to a seventh aspect of the invention there is provided a tape spool for being driven by a tape drive, the tape spool comprising a length of tape wound around an outer face of a generally annular central core, the core also having an inner face, radially inboard of the outer face, wherein the inner face comprises first and second portions spaced along a central axis of the core, wherein a diameter of the first portion of the inner face is greater than a diameter of the second portion of the inner face.

The spool may be configured such that an alignment feature of a spool support may be received by the first portion of the inner face, and said alignment feature cannot be received by the second portion of the inner face, when the spool is supported by the spool support, thereby allowing the spool support to fully support the spool in a first relative orientation between the spool and the spool support in which the alignment feature is received by the first portion of the inner face, and preventing the spool support from fully supporting the spool in a second relative orientation between the spool and the spool support in which the alignment feature is not received by the first portion of the inner face.

The spool may comprise a third portion of the inner face spaced along a central axis from the first and second portions, the third portion having a diameter which is greater that at least one of the diameter of the first portion of the inner face and the diameter of the second portion of the inner face.

The spool may further comprise a retainer feature configured to exert a retaining force on the spool when the spool is supported by a spool support which resists removal of the spool from the spool support.

The retainer feature may comprise the third portion. The third portion may be configured to receive a retainer of a spool support when the spool is supported by a spool support, the retainer co-operating with the retainer feature to exert said retaining force on the spool.

The second portion of the inner face may be located intermediate the first and third portions of the inner face with respect to their positions along the central axis of the core and wherein the third portion has a diameter which is greater than the diameter of the second portion.

The third portion may have a diameter which is less than the diameter of the first portion.

The retainer feature may comprise a magnetic source or a ferromagnetic material, said magnetic source or ferromagnetic material being configured to interact with a magnetic member, in the form of a second ferromagnetic member or a second magnetic source, associated with a spool support which may support the spool, such that said interaction exerts said retaining force on the spool when the spool is supported by the spool support.

The spool may comprise a plurality of ribs which each extend in a generally radial direction inwards from the outer face to a respective radially inner end at the inner face of the spool.

The inner face may be a discontinuous surface which is defined by the radially inner ends of each of the plurality of ribs.

According to an eighth aspect of the present invention there is provided a tape support arrangement for mounting on one or more tape drive supports, the arrangement comprising a tape take up core suitable for supporting a tape; and a tape supply core having a length of tape wound onto it; wherein the tape supply core has a greater outer diameter than the outer diameter of the tape take up core.

According to a ninth aspect of the invention there is provided a tape supply spool for mounting on a tape drive support, the spool comprising a tape supply core having a length of tape wound onto it; wherein the length of the tape wound on the tape supply core is greater than about 250 m, and wherein the outer diameter of the tape supply core is greater than about 20% of an outer diameter of the tape supply spool, defined by the tape, when the tape is wound onto the tape supply core.

As with all of the relevant aspects of the invention, the tape may be a print ribbon for use in a tape drive which forms part of a printing apparatus.

The provision of a tape supply core having a greater outer diameter than the outer diameter of the tape take up core means that the outer diameter of the tape supply core is no longer limited to being the same as that of the tape take up core which has been the industry convention up until this time. The tape supply core having a greater outer diameter than the outer diameter of the tape take up core means that the tape supply core can be enlarged to any desired size. Increasing the diameter of the tape supply core means that the difference between the outer diameter of the tape supply spool when it is fully pre-wound and the tape supply spool when all the tape has been wound off it is minimised. This is useful in embodiments of tape drive in which the supply spool is braked by a substantially constant braking torque in order to induce a desired level of tension within the tape. By minimising the difference in outer diameter of the supply spool during the lifetime of the tape, this helps to minimise the difference in braking force which is applied to the tape during the lifetime of the tape as a result of the combination of changing diameter of the supply spool and the substantially constant braking torque. Consequently, the change in tape tension during the lifetime of the tape is also minimised. Maintaining a more constant tension in the tape during the lifetime of the tape may be beneficial in some applications. For example, if the tape is a printing ribbon which forms part of a printing apparatus, maintaining a more constant tension in the printing ribbon may maintain a relatively consistent printing quality.

It will be appreciated that whilst some of the aspects of the invention discussed above relate to a respective apparatus, corresponding methods of producing or operating such apparatus also falls within the scope of the invention.

It will be appreciated that any of the features discussed in relation to one of the aspects of the invention above may be appropriately applied to any of the other aspects of the invention.

An embodiment of the present invention will now be described, by way of example only, with reference to the accompanying Figures, of which:

Figure 2:
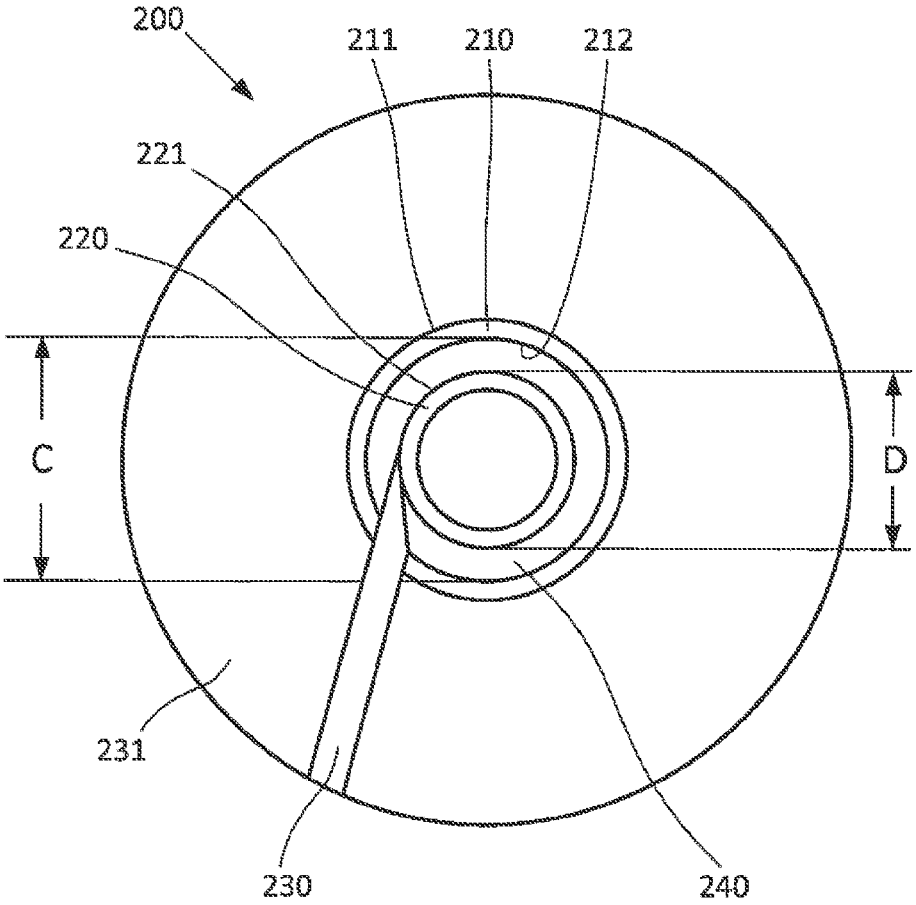
FIG. 2 shows a top-down schematic view of a tape support arrangement according to an embodiment of the present invention.
Figure 3:
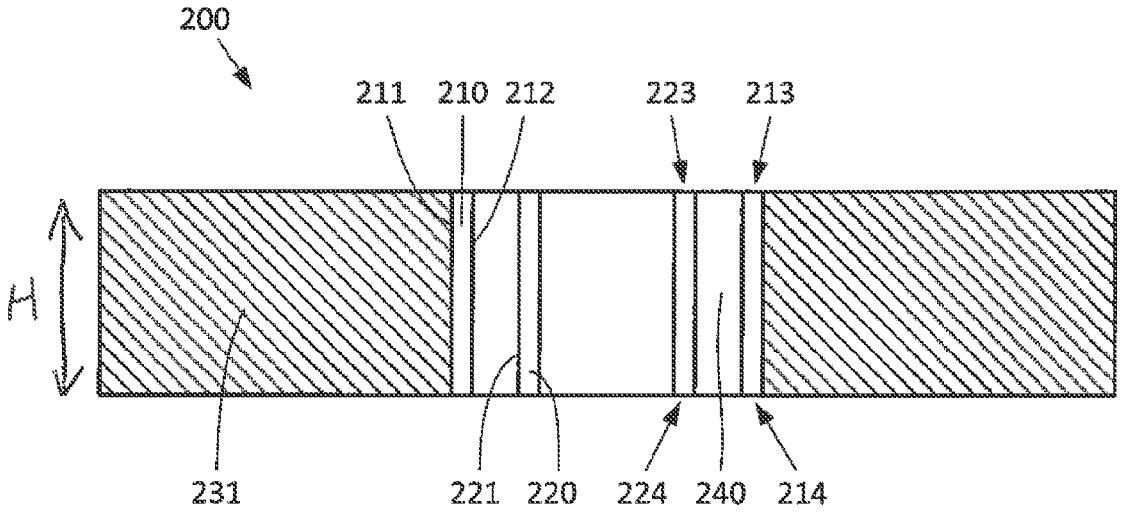
Figure 4:
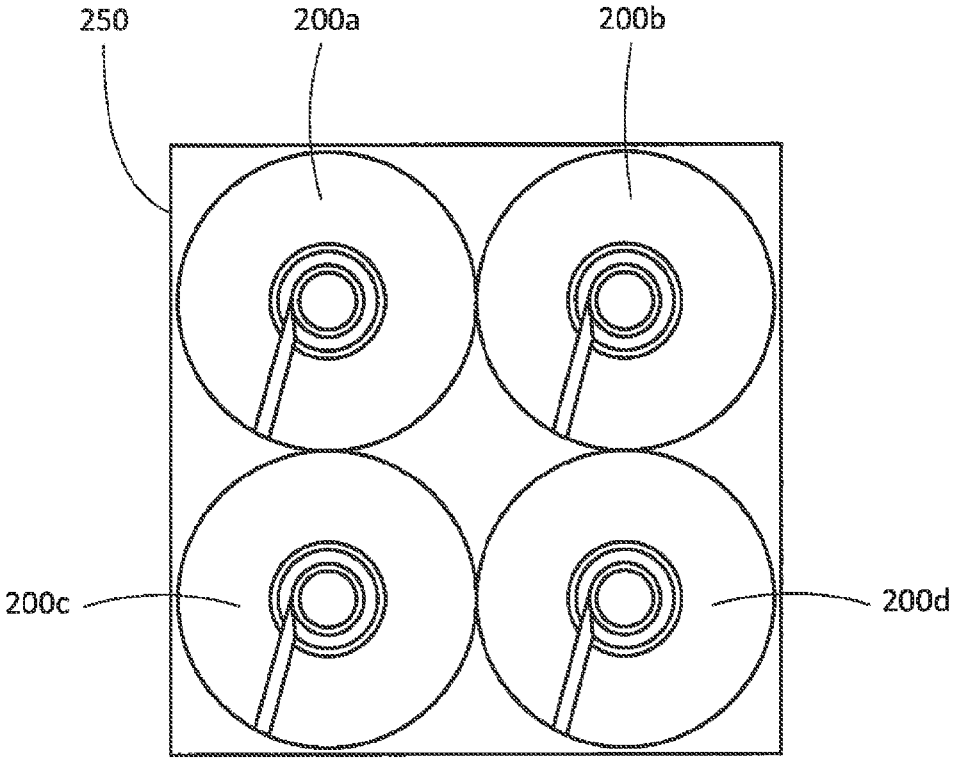
Figure 4A:
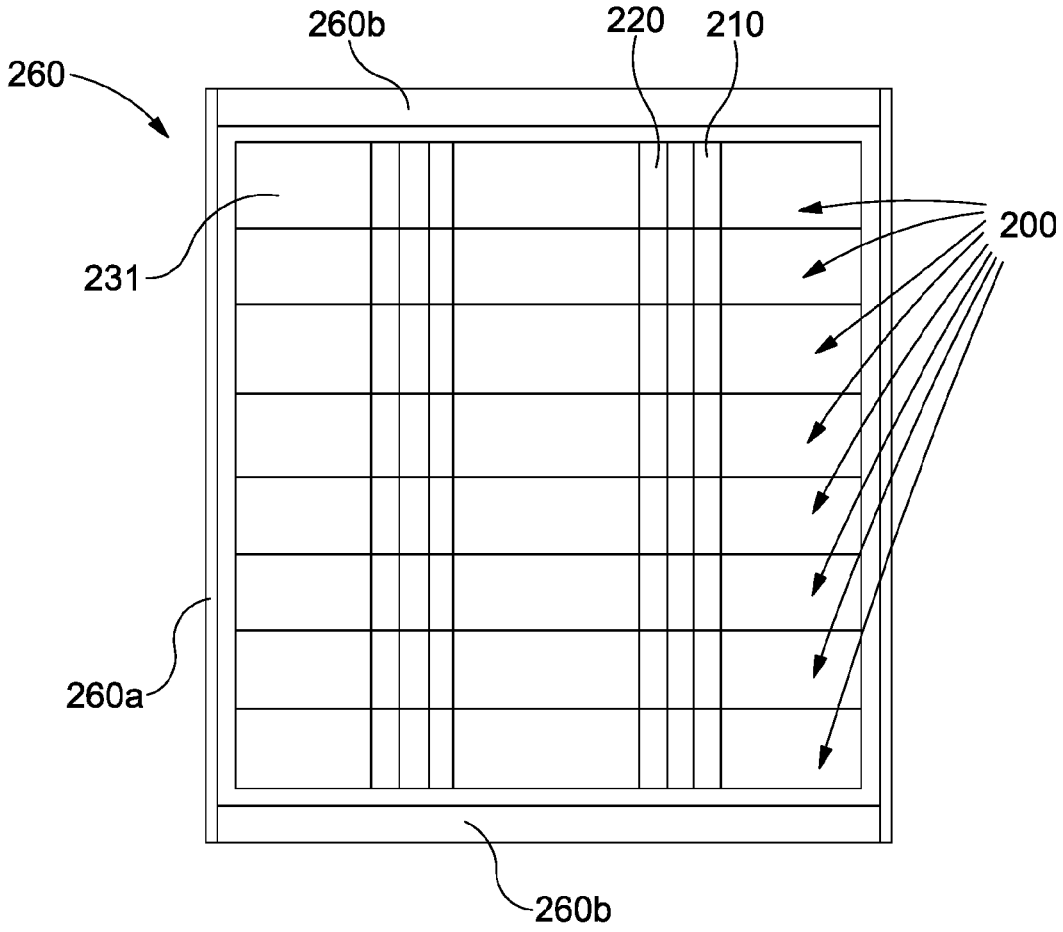
Figure 6:
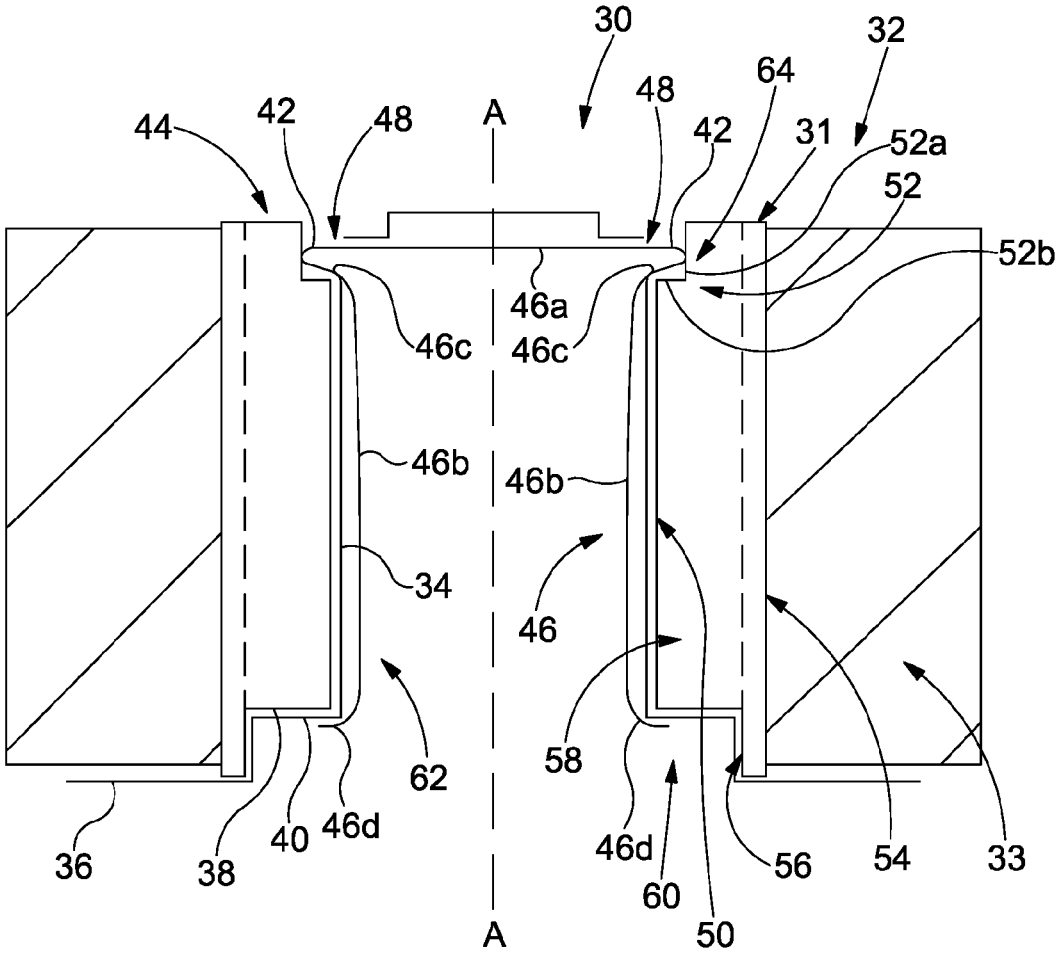
Figure 7:
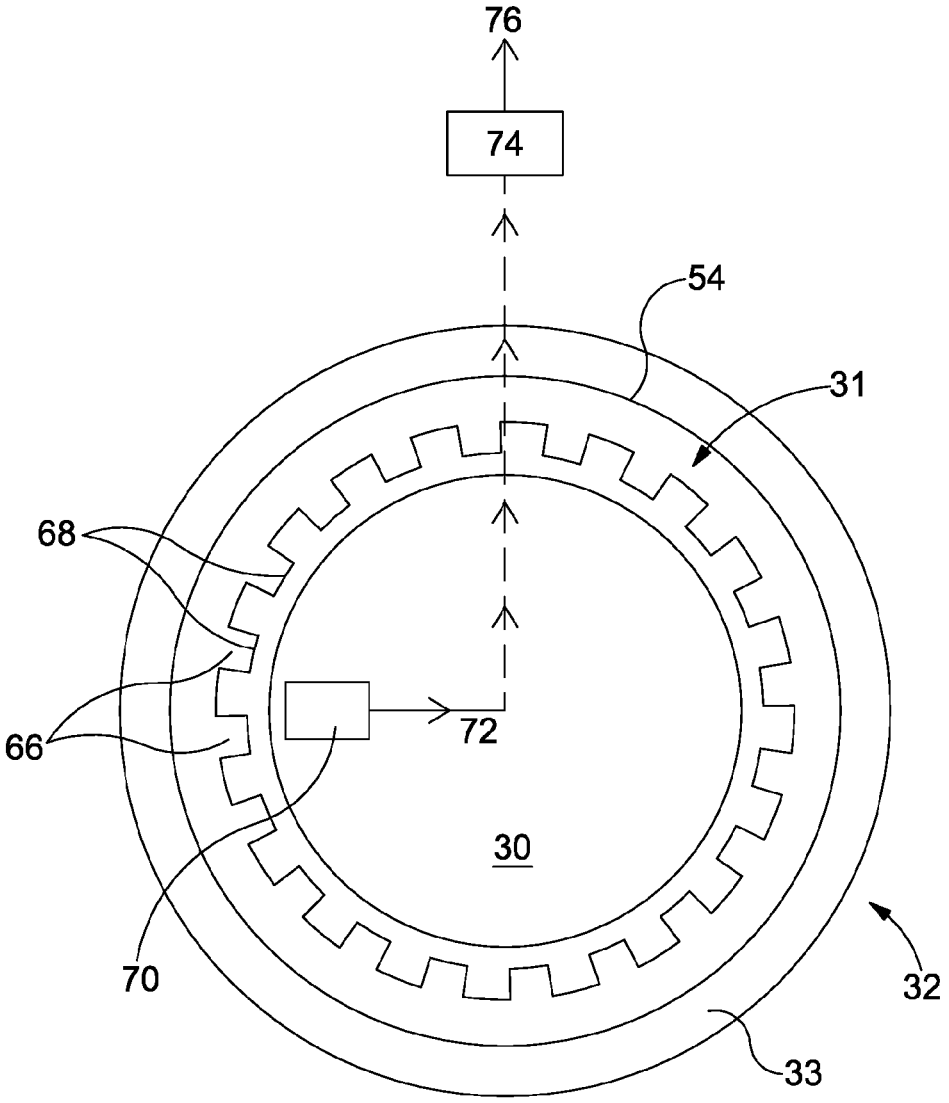
Figure 8:
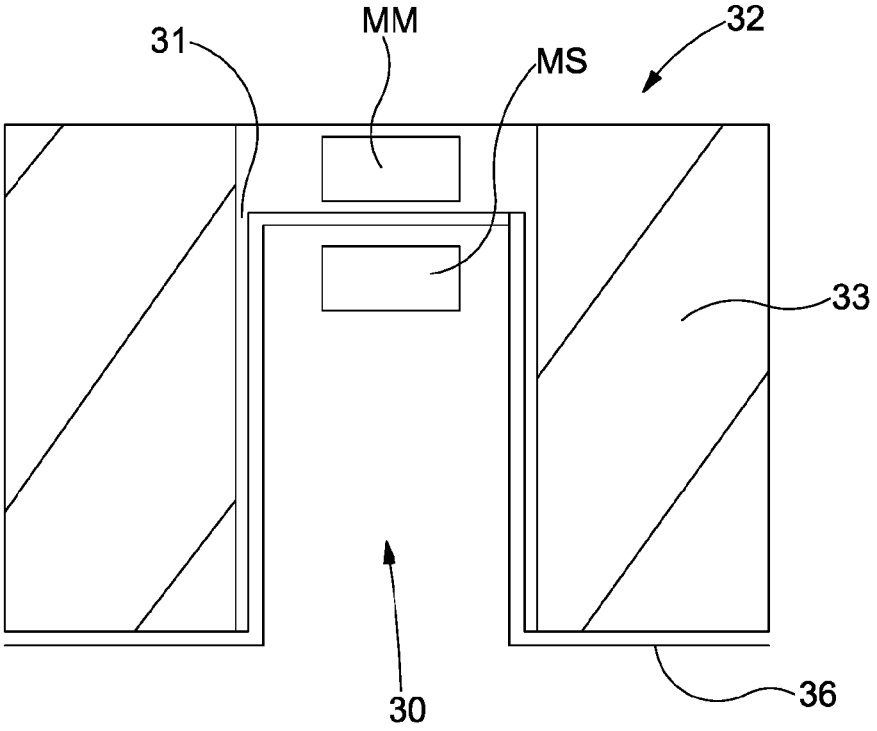

FIG. 3 showy a side-on cross-sectional schematic view of the tape support arrangement shown in FIG. 2;

FIG. 4 shows a top-down schematic view of a plurality of tape support arrangements according to the present invention arranged within a packaging;

FIG. 4*a* shows a schematic cross-sectional view of a plurality of tape support arrangements according to the present invention arranged within a packaging;

FIG. 6 shows a schematic view of a known tape drive apparatus;

FIG. 6 shows a schematic cross section through a spool support and supported spool in accordance with various embodiments of the present invention;

FIG. 7 shows a schematic overhead view of a portion of a tape drive according to various embodiments of the present invention; and FIG. 8 shows a schematic cross-sectional view of a further embodiment of the invention.

Figure 1:
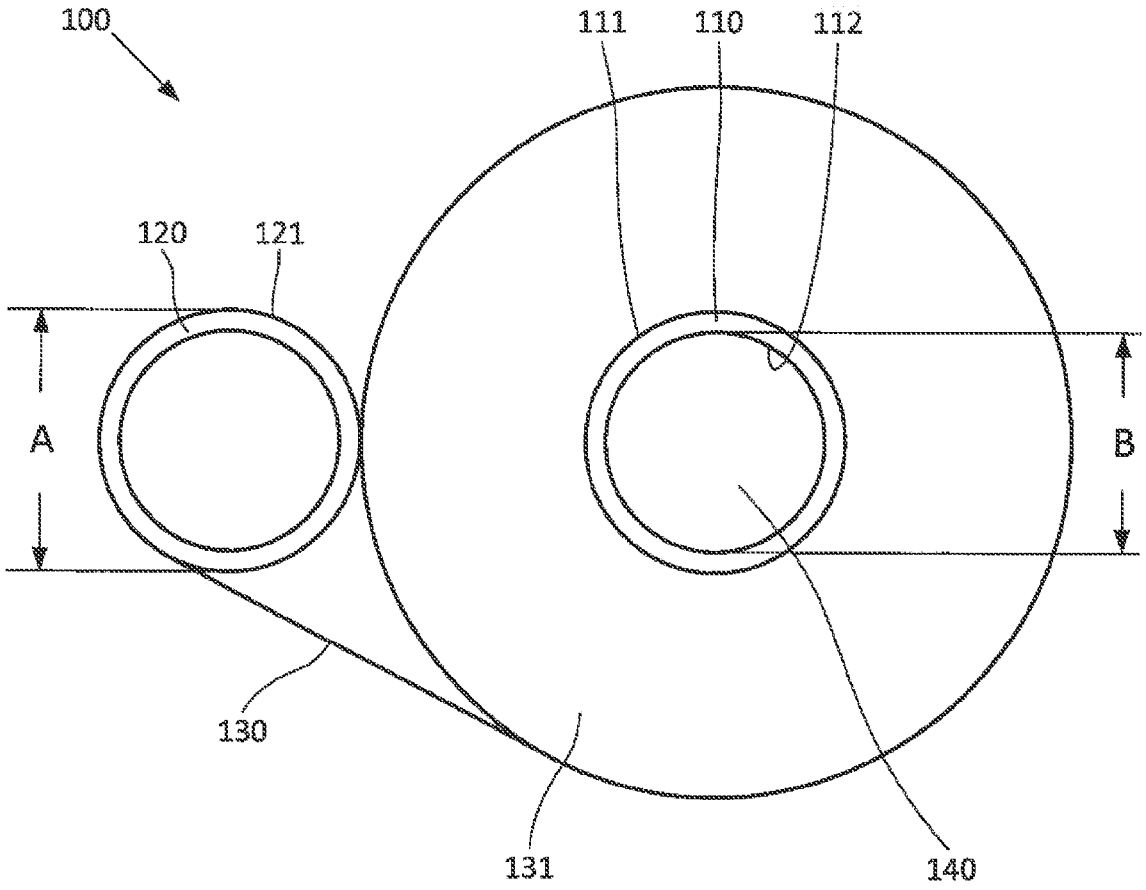
FIGURE 1 PRIOR ART
FIG. 1 shows a top-down schematic view of a prior art tape support arrangement.

FIG. 1 shows a top-down schematic view of a known tape support arrangement. A tape support arrangement 100 comprises a supply core 110 and a take up core 120. The supply core 110 and the take up core 120 each comprise generally cylindrical outer surfaces 111, 121 having substantially equal diameters. A tape 130 extends between the supply core 110 and the take up core 120 and is wound upon the supply core 110 to form a spool 131. The supply core 110 has a generally cylindrical inner surface 112 which is configured for engagement with a tape drive support (not shown) when the tape is mounted within a tape drive. The inner surface 112 defines an internal volume 140 of the supply core which is empty space.

During storage and/or transport of a tape support arrangement, it is desirable for the tape support arrangement to occupy the least amount of space possible. This is so that more tape support arrangements can be stored/transported in a given space, therefore minimising storage and/or transport costs.

FIGS. 2 and 3 show top-down and side-on cross-sectional schematic views of a tape support arrangement according to an embodiment of the present invention. The tape support arrangement 200 comprises a supply core 210 and a take up core 220, having generally cylindrical outer surfaces 211, 221. A tape 230 extends between the supply core 210 and the take up core 220, and is wound upon the supply core 210 to form a spool 231.

The supply core 210 further comprises an inner surface 212 (which in this embodiment is generally cylindrical, but need not be in other embodiments). The inner surface 212 defines an internal volume 240 of the supply core. The inner surface 212 is also configured to be engaged with a tape drive support (i.e. a support of a tape drive, not shown).

In the present embodiment the inner cylindrical surface 212 of the supply core 210, which defines the internal volume 240, extends through the entire body of the supply core 210 from a first end 213 of the supply core 210 to a second end 214 of the supply core 210. As such, the inner surface 212 defines a passage is between the first and second ends 213, 214 of the supply core 210 which constitutes the internal volume 240.

As previously discussed, during storage/transportation of a tape support arrangement it is preferable to arrange a tape support arrangement so that it occupies the least space possible. The alternative tape support arrangement according to the present invention reduces the space occupied by the tape support arrangement as compared to that occupied by the know tape support arrangement. This is discussed in more detail below.

In the known tape support arrangement shown in FIG. 1, the outer diameter A of the take up core 120 is greater than the diameter B of the inner surface 112 of the supply core 110. As such, the take up core 120 cannot be placed within the internal volume 140 of the supply core 110, and therefore the take up core 120 must be located external to the supply core 110 during storage/transport. Furthermore, during storage/transport of the print ribbon assembly 100, as shown in FIG. 1, the take up core 120 is located adjacent the spool 131 such that the outer surface 121 of the take up core 120 is in contact with the spool 131. It will be appreciated that while alternative storage arrangements of the prior art print ribbon assembly 100 are possible, the take up core 120 must always be stored external to the supply core 110.

In the embodiment shown in FIGS. 2 and 3, the outer diameter D of the take up core 220 is less than the diameter C of the inner surface 212 of the supply core 210. As such, during storage of the print ribbon assembly 200, the take up core 220 may be located within the internal volume 240 of the supply core 210 in order to save space. In the current embodiment, the take up core 220 is sized and shaped such that it is smaller than internal volume 240 of the supply core 210. The take up core 220 is therefore able to fit entirely within the internal volume 240 of the supply core 210.

As can be seen most clearly in FIG. 3, both the supply core 210 and the take up core 220 are of substantially the same height H. That is to say, the distance between the first and second ends 213, 214 of the supply core 210 is substantially the same distance as the distance between a first end 223 of the take up core 220 and a second end 224 of the take up core 220. As such, the take up core 220 is locatable within the internal volume 240 of the supply core 210 such that the first end 213 of the supply core 210 is flush with the first end 223 of the take up core 220, and such that, simultaneously, the second end 214 of the supply core 210 is flush with the second end 224 of the take up core 220.

The height H shown in FIG. 3 is measured in a direction which is substantially parallel to an axis about which the cores 210, 220 are designed to rotate when mounted within a tape drive. This direction is also parallel to the longitudinal axis of the generally cylindrical cores and/or the axis about which the cores are rotational symmetric.

It will be appreciated that an alternative embodiment of the present invention may comprise a supply core 210 and a take up core 220 of different heights. For example, the take up core 220 may be of greater height than the supply core 210. As such, in embodiments such as this, it will not be possible to locate the entire take up core 220 within the internal volume 240 of the supply core 210. In this case, when the take up core 220 is located within the internal volume 240, a part of the take up core 220 may protrude outside the internal volume 240. Alternatively, the supply core 210 may have a greater height than the take up core 220, and therefore, in this instance, the entire take up core 220 will once again fit within the internal volume 240 of the supply core 210.

It will be appreciated that a tape support arrangement 200 according to the present invention may comprise a take up core 220 which may be only partially locatable within the internal volume 240. For example, the supply core 210 may be closed part way along its height, such that the internal volume 240 extends only part-way through the supply core 210. When the take up core 220 is located within the internal volume 240, a first portion of the take up core 220 may protrude clear of the supply core 210 such that a second portion of the take up core 220 is located within the internal volume 240 and a the first portion of the take up core 220 is located external to the internal volume 240. However, the most space will be saved where the entire take up core 220 is located within the internal volume 240, as is the case in the embodiment shown in FIGS. 2 and 3. The total volume of space saved will be equal to the volume of the take up core 220 that is located within the internal volume 240. As such, space is saved even when only part of the take up core 220 is located within the internal volume 240.

Although the internal volume 240 in the above described embodiment is defined by a single cylindrical inner surface of the supply core 210, alternative embodiments of the present invention may comprise an internal volume 240 defined by a non-cylindrical surface, or a plurality of separate inner surfaces of the supply core 210. For example, the supply core 210 may comprise other features suitable for engagement with a tape drive support; such as splines, ridges or grooves. It will be appreciated that the internal volume 240 is defined only by the internal geometry of the supply core 210, and is not dependent on the presence or absence of the take up core 220.

It will be appreciated that, although the take up core 220 and supply core 210 described above each include a generally cylindrical outer surface 211, in some embodiments, the take up core 220 and/or supply core 210 may comprise an outer surface which is not cylindrical. For example, the outer surface may comprise features suitable for securing a print ribbon, such as a lip, a flange or a flat. Alternatively, or in addition, the take up core 220 and/or supply core 210 may comprise an outer surface which has a non-circular profile for example a polyhedron, such that the outer surface is a polyhedral prismatic surface.

As shown in FIG. 3, the take up core 220 also comprises a hollow central portion similar to the inner volume 240 of the supply core 210. As such, the take up core 220 may be configured to engage with a tape drive support (not shown) and may comprise any features suitable for engagement with such a support, for example, splines, ridges or grooves. It will be understood that the present invention relates to the relationship between the external features of the take up core 220 and the features of the supply core 210 which define the internal volume 240. As such, the invention is not limited to the described features of the take up core which enable the take up core to be mounted to or supported by a tape drive support.

The tape support arrangement 200 may be for use within a tape drive apparatus. The tape drive apparatus may be configured to wind tape onto or off of one of the take up core or supply core. The tape drive apparatus may be configured to wind tape onto the take up core and wind tape off of the supply core.

The tape support arrangement may support a tape in the form of printer ribbon which carries ink. Such a tape support arrangement may be used as a consumable which is used as part of a tape drive apparatus which forms part of a printer. The printer may be a thermal transfer printer in which the printer includes a print head which transfers ink from the printer ribbon to a substrate, as is well known in the art.

For example, the take up core 220 may be configured to be supported by a first support of a tape drive apparatus, and the inner surface of the supply core 210 may be configured to be supported by a second support of the tape drive apparatus. The take up core 220 may be supported by the first support such that the first support and the take up core 220 co-rotate. Likewise, the supply core 210 may be supported by the second support such that the supply core 210 and the second support co-rotate. Alternatively, the inner surface of the supply core 210 may be supported by the second support such that the supply core 210 can rotates relative to the second support.

In some embodiments a drive mechanism of the tape drive apparatus may drive tape along a tape path between the supply spool (which includes the supply core and tape wound thereon) and the take up spool (which includes the take up spool and any tape wound thereon). In some embodiments the first support may be driven by a motor in order to rotate the take up core 220 and so transfer tape from the supply core 210 to the take up core 220.

Although the tape 230 as described above and as shown in FIGS. 2 and 3 extends between the supply core 210 and the take up core 220, a tape support arrangement 200 according to the present invention may comprise a tape 230 which does not extend between the supply core 210 and the take up core 230. For example, the tape 230 may be wound upon the supply core 210 only, and may not be attached to the take up core 220 when the tape support arrangement 200 is produced. In such embodiments, the tape 230 may be attached to the take up core 220 by a user at a later point, for example, once the tape support assembly 200 has been mounted to a tape drive apparatus.

FIG. 4 shows a plurality of tape support arrangements 200*a*-200*d* arranged for storage within a packaging 250. A first tape support arrangement 200*a*, is located adjacent to a second tape support arrangement 200*b* such that an outer circumference of the tape support arrangement 200*a* (which is the outer circumference of the supply spool of the tape support arrangement) is in contact with an outer circumference of the second tape support arrangement 200*b* (which is the outer circumference of the supply spool of the second tape support arrangement). Likewise, a third tape support arrangement 200*c* is located adjacent to, and in contact with, the first tape support arrangement 200*a*, Finally, a fourth tape support arrangement 200*d* is located adjacent to, and in contact with, the second and third tape support arrangements 200*b*, 200*c*.

The print ribbon assemblies 200*a*-200*d* may be stored within a packaging 250, such as a crate or a box.

Alternatively, or in addition, a plurality of tape support arrangements may be stacked such that a first end of a first tape support arrangement is in contact with a second end of a second tape support arrangement. Furthermore, in such an arrangement of tape support arrangements the first and second tape support arrangements may be concentrically aligned such that the outer circumference of the first tape support arrangement (which is the outer circumference of the supply spool of the first tape support arrangement) is concentric with the outer circumference of the second tape support arrangement (which is the outer circumference of the supply spool of the second tape support arrangement). The ability to stack a plurality of tape support arrangements in an end-to-end fashion, with the first and second tape support arrangements concentrically aligned, and with the take up cores of each tape support arrangement being located in the internal volume of their respective supply core, may facilitate the packing of multiple tape support arrangements into a mailing tube. Mailing tubes are a well-known form of packaging which comprises a tube (usually, but not necessarily, formed from a cardboard material) into which one or more articles to be packaged can be packed and then the ends of the tube can be sealed (usually, but not necessarily, by plastic end caps) for transport and/or storage. It will be appreciated that the ability to store and/or transport multiple tape support arrangements according to the present invention into a mailing tube provides a more efficient way of storing and/or transporting multiple tape support arrangements according to the present invention as compared to those possible using known tape support arrangements.

FIG. 4*a* shows a schematic cross-sectional view of multiple tape support arrangements 200 according to the present invention stacked in an end-to-end fashion and packaged within a mailing tube 260. The mailing tube 260 has a main tube portion 260*a* and removable end caps 260*b* at each end of the main tube portion which enclose the tape support arrangements 200 within the mailing tube 260.

Although the embodiment shown in FIG. 4*a* shows the multiple tape support arrangements contained within a mailing tube of generally circular cross-section (perpendicular to its longitudinal axis), it will be appreciated that, in other embodiments, the multiple tape support arrangements may be contained in any appropriate packing tube (having any appropriate cross-section perpendicular to its longitudinal axis), provided the packing tube is capable of containing the multiple tape support arrangements when they are stacked in an end-to-end fashion in the manner previously discussed.

It will further be appreciated that alternative arrangements of the tape support arrangement (and alternative arrangements of multiple tape support arrangements) are possible and are not limited by the arrangements disclosed herein.

Figure 5:
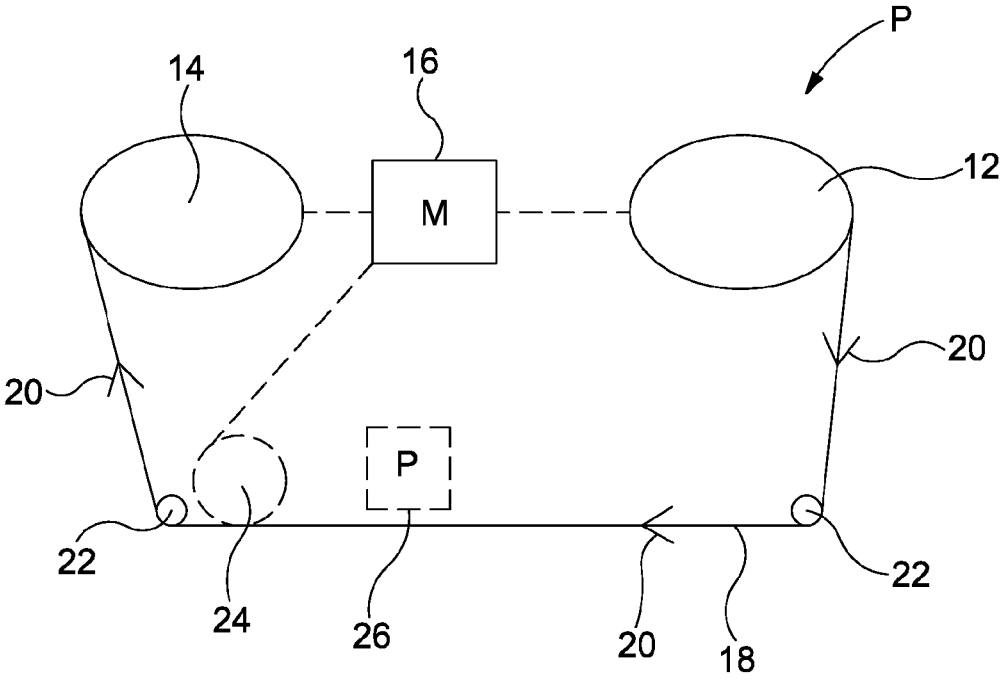

FIG. 5 shows a known tape drive arrangement 10. The tape drive arrangement 10 includes a supply spool 12, and take-up spool 14 and a motive device 16. The motive device 16 drives tape from the supply spool 12 to take-up spool 14 along a tape path 18 in a direction 20. Rollers 22 help to define the tape path. It will be appreciated that, depending upon the exact configuration of the tape drive, there may be any appropriate number of rollers which serve to define the tape path.

The motive device 16 drives the tape along the tape path 20 from the supply spool 12 to the take-up spool 14. This may be achieved in any number of known, appropriate ways. For example, the motive device may drive rotation of i) the take-up spool 14, ii) the take-up spool 14 and supply spool 12, or iii) a drive roller 24 and the take-up spool 14.

In addition, it is common for known tape drives to include some arrangement which assists in maintaining a desirable level of tension within a tape as it travels along a tape path 18. This may be achieved in any number of known ways including use of a drive roller 24 as previously discussed, use of a dancing arm and for the use of some form of braking apparatus which acts upon the supply spool support so as to either apply a braking force to the supply spool support which opposes the rotation of the supply spool support and supported supply spool or which reduces the speed of rotation of the supply spool support and supported supply spool so that the speed of rotation of the supply spool results in the tape being fed off the supply spool at a slower speed than that at which tape is taken up onto the take-up spool 14.

In an example where the tape drive 10 forms part of a printing apparatus the tape drive 10 may drive a tape in the form of a print ribbon. In such instances, the tape path 18 may be such that the print ribbon is driven from the supply spool to the take-up spool past a print head 26.

In known tape drives it is common for the supply spool 12 and the take-up spool 14 to be supported upon respective supply and take-up spool supports. The spool supports within known tape drives are commonly configured such that each spool support is mounted to a base plate such that the spool support may rotate relative to the base plate. In this way, when the spool support is supporting a spool, a spool support and supported spool can co-rotate such that both rotate relative to the base plate to which the spool support is secured.

It is a commonly held view in the field of tape drives that spool supports which are configured to co-rotate with their supported spools are the only viable type of spool support. This is because, by making a supported spool co-rotate with the spool support, this enables the spool support to be mounted to the base plate with an appropriate form of bearing such that frictional losses caused by the necessary rotation of the spools during operation of the tape drive are minimised.

FIG. 6 shows a schematic cross-section through a spool support according to an embodiment of the present invention. The spool support 30 is suitable for supporting a tape spool 32. In this case the tape spool 32 is a supply spool of the tape drive of which the spool forms part. It will be appreciated that the spool support 30 is equally capable of supporting a tape take-up spool of a tape drive. The spool support 30 comprises a support surface 34 and is mounted to a base plate 36 of the tape drive. The support surface 34 is configured such that, in use, as tape is removed from (or, in the case of a take up spool, wound onto) the supported spool 32, the spool 32 rotates relative to the spool support 30 such that the spool 32 rotates around the support surface 34. The supported spool 32 comprises a central core 31 around which tape material 33 is wound.

In the present case, the spool support 30 is generally cylindrical and extends along a central axis A. The supported spool rotates relative to the spool support 30 such that the spool 32 rotates around the central axis A.

In this situation, in which the spool support is fixed relative to the tape drive base plate and the supported spool rotates relative to a spool support (in particular the support surface of the spool support) is quite different to known spool support arrangements in which the supported spool is fixed for rotation relative to the spool support, and the support spool and spool support co-rotate (i.e. rotate with one another), relative to the base plate.

One benefit of the spool support according to the embodiment of the present invention shown in FIG. 6 is that because the spool support is fixed with respect to the base plate of the tape drive, there are no moving parts which are required to enable the supported spool to rotate. Because of this the tape drive is both easier and cheaper to manufacture. In addition, the lack of the requirement for any moving parts to facilitate rotation of a supported spool means that the tape drive is more reliable (i.e. less likely to suffer part failure).

The previously discussed support surface 34 of the spool support 30 is a generally cylindrical surface. The support surface 34 is generally parallel to the axis A of rotation. It will be appreciated that, when supported by the spool support, a generally radial surface 38 of the spool 32 is supported by a corresponding generally radial surface 40 of the spool support 30. This generally radial surface 40 is substantially perpendicular to the axis A of rotation. In some embodiments of the invention the support surface may be considered to only be a surface which is generally parallel to the axis of rotation (e.g. surface 34); in other embodiments the support surface may be considered to be a surface which is generally perpendicular to the rotation axis A (e.g. surface 40); and in some embodiments the support surface may be considered to be a combination of surfaces which are parallel to the axis A of rotation and perpendicular to the axis A of rotation.

Furthermore, in some embodiments, the support surface may not be parallel to or perpendicular to the rotation axis A. For example, in some embodiments, the support surface may be such that it extends in a direction which has a component which is parallel to the rotation axis A and a component which is perpendicular to the rotation axis A—for example the support surface may be generally frustoconical. In such an embodiment the generally frustoconical support surface is orientated such that the portion of the surface which has a relatively small diameter (with respect to the rotation axis A) is located further from the base plate 36 than the portion of the frustoconical support surface which has a relatively large diameter. In this way, when a spool is mounted onto the spool support, the frustoconical surface serves so as to guide the spool onto the spool support whilst centring the spool, with respect to the rotation axis A, on the spool support. This may be beneficial in some applications because it will enable a supported spool to be efficiently centred on the spool support and therefore enable efficient rotation of the spool on the spool support.

It will be appreciated that, unlike known spool supports, the spool support according to the embodiment of the present invention shown in FIG. 6 does not include any form of bearing to facilitate rotation of the spool. Instead, the support surface of the spool itself acts as a bearing surface which cooperates with a corresponding surface of the spool so as to facilitate rotation of the spool. It will be appreciated that because the support surface of the spool support (and corresponding surface of the spool) act as a bearing surface, there will be frictional forces which act between the support surface and the corresponding surface of the spool core.

Such frictional forces may lead to wear. Because of this it is preferable that the support surface and corresponding spool core surface (or at least one thereof) are formed from a material which has a relatively low coefficient of friction. For example, the support (and hence the support surface) may be formed from acetal plastic; and the spool core (and hence the surface of the spool core) may be formed from polystyrene or another plastic material. Other examples of plastic materials from which the support or spool core may be formed include ABS Polycarbonate, PVC, Nylon, PPS (polyphenylene sulphide) and PBT (polybutylene terephthalate). Suitable materials may have a coefficient of friction between about 0.15 and 0.4. In other embodiments, at least one of the support surface of the spool support and corresponding surface of the spool core may be coated in a low friction material—for example, Teflon.

By utilising materials with a relatively low coefficient of friction for the bearing surfaces (support surface and corresponding surface of spool core), this will minimise wear of the spool support or supported spool due to friction during use.

It is also worth noting that the spool support is by its nature a permanent part of the tape drive, whereas the supported spool (and hence spool core) are consumable items which are used and then disposed of. Consequently, it will be appreciated that it is of greater importance that wear due to friction is minimised with respect to the spool support as compared to that of the core of the spool—worn spool core will be replaced when the supported spool is replaced. Consequently. In some embodiments, the support surface of the spool support may be formed from a material which is harder than that of the corresponding surface of the care so that the surface of the core preferentially wears, in use, due to friction as compared to the support surface of the spool support. Again, examples of suitable materials are acetal plastic for the support and polystyrene for the spool core. Other examples of plastic materials from which the support or spool core may be formed include ABS Polycarbonate, PVC, Nylon, PPS (polyphenylene sulphide) and PBT (polybutylene terephthalate), Suitable materials may have a coefficient of friction between about 0.15 and 0.4.

As previously discussed, the aforementioned spool support according to the present invention may support either a supply spool or a take-up spool of a tape drive. In some embodiments of tape drive it is desirable to maintain the tension within the tape path within predetermined limits (e.g. high enough such that the tape does not go slack, but not so high that it causes the tape to undesirably stretch or break). One way of achieving this is to apply some kind of braking which resists rotation of the supply spool. The braking of the supply spool resists advancement of the tape along the tape path 18 by the motive device 16 thus resulting in an increase in tension of the tape in the tape path 18.

In light of the above, in some embodiments, a spool support according to the present invention as discussed above may be configured to support a supply spool and may include a braking arrangement, the braking arrangement being configured to apply a braking force to the supply spool and thereby resist relative rotation between the supply spool and the supply spool support (and hence between the supply spool and the base plate 36). Because the braking force resists rotation of the supply spool, the braking force may also be referred to as a braking torque.

It will be appreciated that any appropriate braking arrangement which can apply a braking force to the supply spool to resist rotation of the supply spool may be used.

In the particular embodiment of the invention shown in FIG. 6, the braking arrangement includes a braking contact 42 which is configured to protrude beyond the support surface 34 to contact a portion 44 of the supply spool 32 supported by the supply spool support to thereby apply said braking force to the supply spool 32.

In this embodiment the braking contact takes the form of two opposed elbow portions of a resilient member 46. The resilient member 48 is supported by the supply spool support 30. In particular, in this embodiment, the resilient member 46 takes the form of a substantially planar spring formed of generally round cross-section wire. A wire spring of this type may also be referred to as a wire form. The wire may be formed of any appropriate material, for example, steel. It will be appreciated that such a suitable material may be flexible enough to accommodate a spool being mounted and/or removed from a spool support (see discussion later within this document) and may be harder than the material of the portion of the core contacted by the braking contact such that as it supplies a braking force to the core 31 of the spool 32, the friction between the braking contact 42 and the spool core is such that the core is worn in preference to the braking contact. The reasons why the core of the spool preferentially wearing as compared to the breaking contact have already been discussed above in relation to the preferential wear of a supported spool core as compared to the spool support. As such, these reasons are not repeated here.

The profile of the resilient member as viewed in FIG. 6 is generally that of an upturned vase. As such, the resilient member 46 includes a base portion 46*a* from which two legs 46*b* depend via respective elbow portions 46*c* which form the braking contact 42. Tips 46*d* on each of the legs 46*b* are secured to a base portion of the supply spool support. In other embodiments the resilient member may be secured to any appropriate portion of the tape drive—for example, the resilient member may be secured to the base plate.

As such, the tips 46*d* of the resilient member 46 constitute first and second ends, each of which is secured to the base portion of the supply spool support. A portion of the spring 46 is located within the generally cylindrical supply spool support and the central axis A of the generally cylindrical spool support lies in the plane of the substantially planar wire spring. In particular, the supply spool support 30 includes a pair of diametrically opposed openings 48 through which the elbow portions of the spring 46 which constitute the braking contact 42 protrude. The remaining portions of the spring 46 are located inside the spool support 30. In use, when a supply spool 32 is supported by the spool support 30 the braking contact 42 contacts a portion of a core 31 of the spool 32. In the embodiments shown, the braking contact 42 contacts a portion 52 of an inner face 50 of the spool core 31. In particular, in the embodiment shown in FIG. 2, the portion 52 includes a substantially circumferential wall 52*a* and a substantially radial wall 52*b*. The Figure shows the braking contact 42 contacting the circumferential wall 52*a*.

In other embodiments the spool support and supported spool may be configured such that the braking contact contacts the radial wall in addition to, or as an alternative to, the circumferential wall. That is to say, the present invention encompasses a braking contact contacting any appropriate portion of the supported spool. For example, the portion of the spool contacted by the braking contact may be a substantially radial surface, a substantially circumferential surface, a combination of a substantially radial surface and a substantially circumferential surface, or any appropriately shaped surface. Furthermore, the present invention also encompasses that the spool support and supported spool may be configured such that the braking contact may contact any appropriately located portion of the spool core in use. For example, in the presently described embodiment the braking contact contacts an inner face of the spool core. In other embodiments the braking contact may contact an axial end of the core of a supported spool, or may contact both an axial end and an inner face of the core of the supported spool.

In addition, whilst the braking contact in the presently described embodiment takes the form of a wire spring protruding from the spool support, in other embodiments the braking contact may take any appropriate form provided that it can exert a braking force on a supported spool which resists rotation of the spool. For example, the braking arrangement may include a braking contact in the form of a brake shoe which is urged radially outwards so as to contact the core of the spool support.

In use, the friction between the braking contact 42 and the core 31 of the spool 32 constitutes a braking force which is applied to the supply spool to resist rotation of the supply spool.

As previously discussed, the braking of the supply spool may be advantageous in certain embodiments of tape drive because it enables the tension of the tape in the tape path between the supply spool and take-up spool to be increased. In the case where the tape drive is a drive which drives printing ribbon within a printer, such tension within the print ribbon may be desirable so as to ensure satisfactory printing quality.

In another embodiment of the present invention, such as that shown in FIG. 8, the braking arrangement of the supply spool may include a magnetic source. Such a magnetic source may be a permanent magnet or a selectively energisable electromagnet. Any appropriate magnetic source may be used provided it is capable of producing a magnetic field.

An example of supply spool including a braking arrangement having a magnetic source is one in which a permanent magnet is fixed to the supply spool support of any appropriate location, such as, for example, at the end of the supply spool furthest from the base plate and/or at a point inside a circumferential surface of the spool support. The magnetic source is mounted to the spool support so that it is not free to rotate, for example, such that it is fixed against rotation relative to the spool support.

A magnetic member which is susceptible to experiencing a force exerted on it by the magnetic source is mounted to the supply spool at a location such that the magnetic member can effectively have a force exerted on it by the magnetic source. For example, in the case where the magnetic source MS is located at the end of the supply spool support 30 which is located furthest from the base plate 36, the spool 32 (and, in particular the core 31) may take the general form of a closed cylinder (i.e. which is closed at one end) and the magnetic member MM may be mounted to the spool at the closed end. In an example in which the magnetic source is located inside the circumferential surface of the supply spool support, the magnetic member may be located at a corresponding position (when the spool is supported by the spool support) adjacent the internal circumferential surface of the core of the spool.

As previously mentioned, the magnetic member may take any appropriate form which is susceptible to having a magnetic force exerted on it by the magnetic source. For example, the magnetic member may be a permanent magnet or may be formed from a ferromagnetic material.

In some embodiments it is preferable that the magnetic member is formed from a ferromagnetic material as opposed to being formed as a permanent magnet. The reason behind this is that it may cost more to incorporate a permanent magnet into the spool (as compared to incorporating a ferromagnetic member into the spool). As previously discussed, it is common practice that the tapes (and supporting cores) used within a tape drive are a consumable item. Consequently, in some embodiments, anything that can be done to minimise the cost of the tape/spools may be beneficial.

In use, the magnetic source of the braking arrangement exerts a magnetic force on the magnetic member which may constitute a braking force of the type previously discussed. The magnetic force exerted by the magnetic source on the magnetic member may in itself constitute a braking force between the supply spool support and the supply spool which resists relative rotation therebetween. Alternatively, or in addition, the magnetic force exerted by the magnetic source on the magnetic member may result is friction between the spool support and supported spool, and the friction may itself constitute a braking force. For example, in the previously discussed embodiment in which a magnetic source is located at the end of the spool support and the corresponding magnetic member is located in the closed end of a supported spool the magnetic source may exert a magnetic force on the magnetic member such that the enclosed end of the spool is attracted towards the end of the spool support in which the magnetic source is located. This attractive force will cause the closed end of the spool to be urged against the end of the spool support. The closed end of the spool being urged into contact with the end of the spool support will increase the frictional force between the spool support and the supported spool which results from the aforementioned contact. The increased frictional force may constitute the aforementioned braking force.

In some embodiments the magnetic source may be an electro magnet. As is well known, the current provided to the electro-magnet is related to the magnetic force produced by the electro-magnet (i.e. the magnetic force exerted on the magnetic member) such that an increase in current supplied to the electro-magnet results in an appreciated that by controlling the current supply to the electro-magnet it is possible to control the magnetic force exerted by the magnetic source on the magnetic member, and consequently, the braking force which is exerted on the supported spool as a result of the magneto force. An increase in magnetic force exerted by the electro-magnet on the magnetic member will, of course, result in increased braking force (A decrease in magnetic force exerted by the electro-magnet on the magnetic member will result in decreased braking force).

By being able to vary the braking force exerted on the spool support, it may be possible to adjust operating characteristics of the tape drive. For example, by increasing the braking force between the supply spool and the spool support, it may be possible to increase the tension of the tape in the tape path (and by decreasing the braking force between the supply spool and the spool support, it may be possible to decrease the tension of the tape in the tape path). Furthermore, it may be possible to increase the braking force at a desired time so as to cause the tape drive to come to a halt more quickly. In addition, it may be possible to decrease the braking force on the supply spool in order to increase the operating speed of the tape drive.

The embodiment of the invention shown in FIG. 6 also includes features according to another aspect of the present invention. That is to say, the embodiment shown in FIG. 6 includes a retainer arrangement. In the embodiment shown in FIG. 6 a retainer arrangement is formed by the elbows 46*c* of the resilient member 46. The retainer is configured to exert a retaining force on the spool 32 supported by the spool support 30 which resists removal of the spool 32 from the spool support 30. This is achieved as follows.

The spool 32 which is supported by the spool support 30 includes a core 31 having an inner face 50 which includes a step portion 52. The step portion 52 is formed between a portion of the inner face of the core which has a relatively large diameter and an adjacent portion of the inner face which has a relatively small diameter. The step portion 52 constitutes an engagement feature of the supported spool 32.

In use, when a spool is supported by the spool support (as shown in FIG. 6), the retainer arrangement prevents the supported spool from inadvertently moving along the spool support 30 away from the base plate 36. This is achieved because the retainer (in this case in the form of the elbows 46*c* of the resilient member 46) exerts a retaining force on the spool 32, and, in particular, on the engagement feature in the form of the step portion 52. This is because, as the supported spool 32 is moved in a direction which is generally parallel to axis A away from the base plate 36, the retainer (in this case in the form of the elbows 46*c* of the resilient member 46) abuts the engagement feature (in this case in the form of the step portion 52) of the supported spool 32 such that the retainer exerts a retaining force on the spool via the engagement feature 52.

In the presently described embodiment the retainer resilient member is a retainer spring. However, it would appreciated that, in other embodiments, any appropriate resilient member may be utilised as part of the retainer arrangement.

A retainer according to some embodiments of the present invention may be mounted to the spool support and the engagement feature may form part of the supported spool, particularly the core of the supported spool. In other embodiments a retainer according to the present invention may be mounted to the supported spool (particularly the core of the supported spool) and the engagement feature may form part of the spool support.

In the presently described embodiment the engagement feature of the supported spool is a step portion of the inner face 50 of the core 31. This may also be referred to as a shoulder portion. It will be appreciated that any appropriate engagement feature, which, in this embodiment, forms part of the supported spool may be used provided that the retainer can engage the engagement feature to exert a retaining force on the spool. For example, the engagement feature may include a flange or a recess, such as a channel. Any such flange or recess may be located on an inner face of the spool core. The flange may protrude from the remaining portion of the inner face of the core such that the diameter of the flange is less than the diameter of the portion of the inner face from which is protrudes. Conversely, the recess (for example, channel, groove or the like) may have a diameter which is greater than that of the portion of the inner face of the core and that of a portion of the inner face adjacent the recess.

It will be appreciated that in another embodiment of the invention the engagement feature may be located at a location on the spool other than the inner face of the core.

For example, the engagement feature may be located at one of the axial ends of the spool core.

As previously discussed, in the present embodiment of the invention shown in FIG. 6, the retainer takes the form of a retainer spring and the retainer spring 46 has first and second ends 46*d*, each of which is secured to a base portion of the supply spool support 30 in the manner previously discussed. As such, at least a portion of the retainer spring is located within the generally cylindrical supply spool support 30 such that the retainer spring intercepts a central axis A of the spool support. In the present case, the retainer spring is a substantially planar wire spring. The plane of the retainer spring is such that the central axis A of the spool support lies within the plane of the retainer spring. In other embodiments the retainer spring may be secured to any appropriate portion of the tape drive for example, the retainer spring may be secured to the base plate.

In other embodiments the retainer spring may take any appropriate form. For example, the retainer spring may not be planar and may have a three dimensional form.

In the present embodiment the resilient member (in the form of wire spring 47) of the retainer arrangement is the same resilient member as that of the braking arrangement which has previously been discussed above. Whilst this is preferable because, in the embodiments of the invention including both the retainer arrangement and a braking arrangement, it reduces the number of parts of the tape drive, it will be appreciated that, in other embodiments, the resilient member of the retainer arrangement and the resilient member of the braking arrangement may be separate entities.

In other embodiments of the present invention, the retainer arrangement may include a retainer magnetic source. The retainer magnetic source may be mounted to the spool support and the support spool may include a magnetic member such that the retainer magnetic source interacts with the magnetic member so as to exert the retaining force on the spool which resists removal of the spool from the spool support.

The configuration of the magnetic source and corresponding magnetic member which form part of the retainer arrangement are the same as discussed above in relation to the magnetic braking arrangement. As such, unnecessary repetition of the configuration of an appropriate magnetic source and corresponding magnetic member is avoided.

In some embodiments which include both a magnetic braking arrangement and a magnetic retainer arrangement, the magnetic source and corresponding magnetic member for each of the arrangements may be one and the same. In other embodiments the magnetic source and corresponding magnetic member of each of the arrangements may be different.

As previously discussed, known tape spools tend to come pre-wound. It will be appreciated that, for a given orientation of tape spool, the tape will be wound onto it in either a clockwise fashion or anti-clockwise fashion. If the orientation of the tape spool is then changed (i.e. such that the tape spool is inverted along its central axis), then the direction of the wound tape will appear reversed. The applicant has discovered that the operators of some tape drives may inadvertently mount a wound spool of tape onto a spool support of the tape drive in an incorrect orientation. If this is the case then the incorrectly mounted spool of tape will unwind in an opposite direction to that desired. This may result in undesirable effects when such a tape drive is operating. For example, if a supply spool of a tape drive is mounted in the incorrect orientation, as tape is unwound from the supply spool then the tape on the supply spool may not unwind as readily as if the supply spool is in the correct orientation, and/or the tape path may be caused to alter such that the tape path travels along an undesirable path—such that it impinges upon other components of the tape drive in an undesirable manner. In addition, if the tape is a print ribbon which has ink only on one side of the tape, then if tape is unwound from the supply spool in the wrong direction then the ribbon will pass the printhead so that the wrong side of the print ribbon is adjacent the printhead—this will reduce the quality of the print, or prevent printing altogether.

One way of addressing the problem of incorrect alignment of a spool when it is mounted on a spool support of a tape drive is to produce a spool having a core which is closed at one end. In this way, it is only possible to mount the spool to the spool support in the (correct) orientation which enables the spool support to be inserted into the open end of the core/spool.

However, it is common for tape spools which are pre-wound for use in tape drives to be pre-wound on a winding machine which concurrently winds a large number of spools. This is achieved by mounting a plurality of spool cores to a single mandrel such that respective tape can be wound onto each of the cores simultaneously.

It will be appreciated that if a core is closed at one end then it will not be possible to simultaneously mount a plurality of such cores onto the mandrel of a pre-winding machine—a mandrel cannot pass through a closed end of each core.

The spool support and corresponding tape spool shown in FIG. 6 shows an embodiment of the present invention which provides a way of preventing incorrect orientation of the tape spool onto the spool support whilst still enabling a conventional pre-winding machine to pre-wind a plurality of the spools simultaneously.

The present invention, discussed in more detail below, is suitable for use with spool supports which are fixed against rotation relative to the tape drive base plate (i.e. such that there is relative rotation between the spool support and supported spool); and also for well-known spool supports of the type previously discussed which are mounted to the tape drive base plate such that they co-rotate with a supported spool.

FIG. 6 shows a tape spool 32 suitable for being driven by a tape drive. The tape spool 32 comprises a length of tape 33 wound around an outer face 54 of a generally annular central core 31. In the present embodiment the outer face 54 of the core 31 has a diameter relative to a central axis A which is substantially constant. The core 31 also has an inner face 50. The inner face 50 is radially (relative to the axis A) inboard of the outer face 54. The inner face 50 comprises a first portion 56 and second portion 58. The first and second portions 56, 58 are spaced along the central axis A of the core. The diameter (relative to the central axis A) of the first portion 56 of the inner face 50 is greater than the diameter of the second portion 58 of the inner face 50.

The spool is configured such that an alignment feature may be received by the first portion 56 of the inner face 50, whereas the alignment feature cannot be received by the second portion 58 of the inner face 50. In the present embodiment the alignment feature of the spool support takes the form of a stepped base portion 60 of the spool support 30. In other embodiments the alignment feature may take any appropriate form. The stepped base portion 60 of the spool support 30 is located at the base of the spool support—i.e. at the end of the spool support closest to the base plate 36, in other words, the base portion 60 of the spoof support 30 is located between the base plate 36 and the remaining portion of the spool support.

The diameter of the base portion 60 of the spool support 30 has a diameter (relative to the central axis A) which is greater than the diameter of the remaining, main portion 62 of the spool support. The diameter of the base portion 60 is chosen such than it is greater than the diameter of the second portion 58 of the inner face 50. Furthermore, the diameter of the base portion is less than the diameter of the first portion 56 of the inner face 50. The diameter of the main portion 62 of the spool support 30 is less than the diameter of the second portion 58 of the inner face 50. It follows that the main portion 62 of the spool support 30 can be received by (i.e. will pass through) both the first and second portions 56, 58 of the inner face 50. To the contrary, a stepped base portion 60 of the spool support 30 can only be received by the first portion 56 of the inner face and not by the second portion 58 of the inner face 50.

Because the alignment feature (in this case in the form of a stepped base portion 60) can be received by the first portion 56 of the inner face 50 of the spool 30 the spool and spool support cooperate such that the spool support can fully support the spool 30 in a first relative orientation between the spool in the spool support in which the alignment feature 60 is received by the first portion 56 of the inner face 50 (as shown in FIG. 6). However, because the alignment feature cannot be received by the second portion 58 of the inner face 50 of the spool 30, the spool support 30 is prevented from fully supporting the spool 32 in a second relative orientation between the spool and the spool support (such as an orientation in which the spool is inverted vertically as compared to its orientation shown in FIG. 6).

It follows from the above that the features of the spool and corresponding spool support according to embodiments of the present invention prevent incorrect orientation of the spool relative to the spool support when mounting the spool to the spool support so that the spool can be supported by the spool support. Preventing incorrect orientation between the supported spool and the spool support is beneficial because it prevents the issues discussed above which occur when such incorrect orientation of the spool relative to the spool support occurs.

The tape spool also includes a retention portion 52 (also referred to as an engagement portion—as discussed above) which is configured to exert a retaining force on the spool 32 when the spool 32 is supported by a spool support 30 which includes a retainer arrangement which resists removal of the spool 32 from the spool support 30. The way in which the retainer arrangement of the spool support cooperates with the engagement feature of the spool so as resist removal of the spool from spool support has previously been discussed and, as such, further explanation of this point is not included so as to avoid repetition.

The retention portion of the spool 32 comprises a third portion 64 of the inner face 50. The third portion 64 is spaced along the central axis A from the first and second portions 56, 58. The third portion has a diameter (relative to the central axis A) which is greater than at least one of the diameter of the first portion of the inner face 56 and the diameter of the second portion of the inner face. In this particular embodiment, the third portion has a diameter which is greater than the diameter of the second portion 58 of the inner face 50, but less than the diameter of the first portion 56 of the inner face 50. As discussed, the third portion 64 of the inner face 50 constitutes an engagement feature. The third portion 64 of the face 50 is therefore configured to receive a retainer 48 of the spool support 30 when the spool 32 is supported by the spool support in the manner discussed earlier within this document.

The second portion 58 of the inner face 50 is located intermediate the first and third portions 56, 64 of the inner face 50 with respect to their positions along the central axis A of the core/spool.

As discussed above in relation to various possible, retainer arrangements which constitute embodiments of the present invention, the retainer arrangement may utilise a magnetic source to provide the retention force. In particular, the retainer of the spool support may comprise a magnetic source or a ferromagnetic material. The magnetic source or ferromagnetic material are configured to interact with a magnetic member associated with the spool support so that said interaction exerts said retaining force on the spool when the spool is supported by the spool support. Of course, the retaining force acts so as to retain the spool on the spool support, thereby resisting removal of the spool from the spool support. Depending on whether the retainer comprises a magnetic source or a ferromagnetic material, the magnetic member associated with the spool support takes the form of a second ferromagnetic member (for example, when the retainer feature comprises a magnetic source) or a second magnetic source (for example, when the retainer feature comprises a ferromagnetic material). The interaction between the magnetic retainer feature and the magnetic member exerts the retaining force on the spool when the spool is supported by the spool support.

In the previously described embodiment the core 31 of the spool is solid—that is to say, material fills the entire space between the outer face of the core 54 and the inner face 50 of the core. In other embodiments, this may not be the case. For example, in some embodiments, the core may be hollow (i.e. such that there is air between the inner and outer faces of the core).

In other embodiments, such as that shown in FIG. 7, the spool comprises a plurality of ribs 68 which extend in a generally radial direction inwards (i.e. away from the outer face 54) to a respective radially inner end 68. In some embodiments the radially inner end 68 of each of the ribs is connected to an inner annular portion of the core which defines the inner face of the core. In other embodiments the inner face of the core 31 may be a discontinuous surface which is defined by the radially inner ends of each of the plurality of ribs 66 themselves.

In embodiments in which the inner face of the core 31 is a discontinuous surface defined by the radially inner ends of the ribs it will be appreciated that it may be disadvantageous for a braking contact or a retainer to contact the inner ends of the ribs—as each of the ribs in turn pass the braking contact or a retainer this may cause vibration which may increase wear, cause an undesirable noise and/or result in jerky movement of the supported spool. As such, in embodiments in which the inner face of the core 31 is a discontinuous surface defined by the radially inner ends of the ribs it may be beneficial for the spool support and supported spool to be configured such that the braking contact and/or the retainer (as appropriate) contact a portion of the spool core other than an inner face of the core. For example, in some embodiments the braking contact and/or the retainer (as appropriate) may contact an axial end of the core of a supported spool. In addition or alternatively, the portion of the core contacted by the braking contact and/or the retainer (as appropriate) may be a portion which is a continuous surface which has a constant radius.

It will be appreciated that, in order for an embodiment which includes ribs to have an inner face having a profile such as that shown in FIG. 6, the profile of the ribs when viewed in a plane which contains the central axis A will necessarily match the profile defined by the inner and/or outer faces of the core 31.

It is common for known tape drives to include a take up spool support and a supply spool support which are substantially the same size. Furthermore, it is common for known tape drives to, via respective take up spool and supply spool supports, support a take up spool and a supply spool which have cores which are of the same diameter. Specifically, the inner diameter of the core of the supply spool and the inner diameter of the core of the take up spool may be the same; and the outer diameter of the core of the supply spool and the outer diameter of the core of the take up spool may be the same.

A common internal diameter of the cores used with known tape drives is about 1 inch (about 2.54 cm). It is also common for pre-wound supply spools for use with known tape drives to be wound with certain common lengths of tape: for example, 400 m, 600 m and 800 m.

The applicant has determined that in some applications of the present invention it may be beneficial for the supply spool core to be 'oversized' when compared to known supply spool cores. In particular, the applicant has determined that in said applications it is beneficial for the outer diameter of the supply spool core to be 'oversized' when compared to that of known supply spool cores.

The reason behind this determination is that, as previously discussed, in embodiments of the invention which include a supply spool support including a braking arrangement, the braking arrangement may be used to maintain tension in the tape in the tape path within predetermined operating limits. In order to achieve this, the braking arrangement applies a braking force to the supply spool, which is manifested as a braking torque on the supply spool. The braking torque results in a force being applied to the tape in the tape path which acts in a direction opposite to the direction of movement of the tape along the tape path and results in tension within the tape in the tape path. The force applied to the tape in the tape path (which acts in a direction opposite to the direction of movement of the tape along the tape path), and hence the tension within the tape in the tape path, is dependent upon the braking torque and the distance between the axis of rotation of the supply spool and outer radius of the supply spool (i.e. the outer radius of the tape wound on the supply spool). In particular, ignoring frictional forces and the like, the force applied to the tape in the tape path as a result of the braking force is equal to the braking torque divided by the outer radius of the supply spool.

For a spool, for a given length of tape wound onto a core, the greater the outer diameter of the core, the smaller the difference between the outer diameter of the spool when all of the length of tape is wound onto the core and that when ail of the tape has been wound off the core. As discussed above, the tension in the tape in the tape path is dependent on the radius (or diameter) of the supply spool. As such, by reducing the difference between the outer diameter of the spool when all of the length of tape is wound onto the core and that when all of the tape has been wound off the core, using a core having a greater diameter will result in a tape drive in which the difference in the tension in the tape in the tape path between when all of the length of tape is wound onto the core and when all of the tape has been wound off the core is reduced. Put another way, using a supply spool core having a greater diameter will result in a tape drive in which the tension in the tape in the tape path is more constant throughout the lifetime of the tape as tape is wound from the supply spool onto the take up spool.

It will be appreciated that in some applications, such as when the tape drive forms part of a printing apparatus, it may be advantageous for the tension within the tape to be as constant as possible throughout the lifetime of the tape as tape is wound from the supply spool onto the take up spool.

In the case of a printing apparatus, for example, this is because a change in tension may result in a change in print quality—hence, in the absence of other factors, relatively consistent print ribbon tension results in relatively consistent print quality.

In some embodiments the outer diameter of the core of the supply spool may be chosen such that, for a given length of tape to be wound onto the supply spool for the supply spool to be fully pre-wound, the outer diameter of the supply spool when all the tape has been wound off the supply spool is about 50% or more of the outer diameter of the supply spool when the supply spool is fully pre-wound. Put another way, in some embodiments, the outer diameter of the core of the supply spool may be chosen such that the outer diameter of the supply spool at the end of use of the supply spool within the tape drive is about 50% or more of the outer diameter of the supply spool at the beginning of use of the supply spool within the tape drive.

This is equivalent to saying that in some embodiments the outer diameter of the core of the supply spool may be chosen such that, for a given length of tape to be wound onto the supply spool for the supply spool to be fully pre-wound, the outer diameter of the supply spool when the supply spool is fully pre wound is about 200% or less of the outer diameter of the supply spool when all the tape has been wound off the supply spool. Put another way, in some embodiments, the outer diameter of the core of the supply spool may be chosen such that the outer diameter of the supply spool at the beginning of use of the supply spool within the tape drive is 200% or less of the outer diameter of the supply spool at the end of use of the supply spool within the tape drive.

In one embodiment, the outside diameter of a wound supply spool is 73 mm and the outside diameter of the supply spool core is 44 mm. In this case the diameter ratio between start and end of supply spool (i.e. between the beginning of use of the supply spool and the end of use of the supply spool) is 1.66. That is to say the outer diameter of the supply spool at the beginning of use of the supply spool within the tape drive is 166% of the outer diameter of the supply spool at the end of use of the supply spool within the tape drive This is equivalent to about a 66% change in tension within the tape during the lifetime of the tape within the tape drive. This compares to a 120% change in tension within the tape during the lifetime of a known supply spool within a tape drive.

In some embodiments of the invention the core of a supply spool may be sized such that its internal diameter is greater than 1 inch. In some embodiments of the invention the core of the supply spool may have a greater outer diameter than the outer diameter of the core of the take up spool. In some embodiments of the invention the cores of the take up spool and of the supply spool may have the same internal diameter, but the core of the supply spool may have an outer diameter which is greater than the outer diameter of the core of the take up spool.

In some embodiments the internal diameter of the supply spool core may be larger than the outside diameter of the core of the take up spool.

The invention claimed is:

1. A tape support arrangement, the arrangement comprising:

a tape;

a tape take up core suitable for supporting the tape; and a tape supply core suitable for supporting the tape, the tape supply core comprising an inner surface, the inner surface defining an internal volume of the tape supply core and being configured for engagement with a tape drive support, wherein the tape take up core is located in the internal volume of the tape supply core; and wherein the tape is at least partly wound about the tape supply core and at least partly wound around the tape take up core.

2. An arrangement according to claim 1, wherein the tape take up core comprises an outer surface and wherein the tape take up core is locatable such that the outer surface of the tape take up core is enclosed by the inner surface of the tape supply core.

3. An arrangement according to claim 1, wherein the tape take up core is locatable such that the tape take up core is fully located within the internal volume of the tape supply core.

4. An arrangement according to claim 1, wherein the tape supply core comprises a first end and a second end, and wherein the inner surface of the tape supply core extends from the first end to the second end such that the internal volume of the tape supply core extends from the first end to the second end.

5. An arrangement according to claim 1, wherein the tape supply core is generally annular such that the inner surface and the internal volume are generally cylindrical.

6. An arrangement according to claim 1, wherein the tape take up core is generally annular and wherein the tape take up core comprises an outer surface, such that the outer surface of the take up spool is generally cylindrical.

7. An arrangement according to claim 1, wherein the tape supply core comprises a height and the tape take up core comprises a height and wherein the height of the tape supply core is substantially the same as the height of the tape take up core.

8. A package comprising a plurality of tape support arrangements according to claim 1, wherein the said plurality of tape support arrangements are stacked in an end-to-end fashion with the tape take up core of each of said plurality of tape support arrangements being located in the internal volume of the respective supply core, and wherein the plurality of tape support arrangements are contained within a packing tube.

9. An arrangement according to claim 1, wherein the tape is wound around an outer face of a generally annular central core of the tape supply core, wherein the inner surface defines an inner face of the generally annular central core that is disposed radially inboard of the outer face, wherein the inner face comprises first and second portions spaced along a central axis of the core, wherein a diameter of the first portion of the inner face is greater than a diameter of the second portion of the inner face.

10. An arrangement according to claim 9, wherein the tape supply core is configured such that an alignment feature of a spool support may be received by the first portion of the inner face, and said alignment feature cannot be received by the second portion of the inner face when a spool is supported by the spool support, thereby allowing the spool support to fully support the spool in a first relative orientation between the spool and the spool support in which the alignment feature is received by the first portion of the Inner face, and preventing the spool support from fully supporting the spool in a second relative orientation between the spool and the spool support in which the alignment feature is not received by the first portion of the Inner face.

11. An arrangement according to claim 1, wherein a length of the tape wound on the tape supply core is greater than about 250m, and wherein an outer diameter of the tape supply core is greater than about 20% of an outer diameter of a tape supply spool, defined by the tape, when the tape is wound onto the tape supply core.

12. An arrangement according to claim 1, wherein the tape is a print ribbon carrying ink.

13. An arrangement according to claim 1, wherein the arrangement is for use within a thermal transfer printer.

14. A tape support arrangement according to claim 1, wherein the tape supply core comprises a greater outer diameter than the outer diameter of the tape take up core.

15. A method of producing a tape support arrangement, the arrangement comprising:

a tape;

a tape take up core suitable for supporting the tape; and a tape supply core suitable for supporting the tape and the tape supply core comprising an inner surface, the inner surface defining an internal volume of the tape supply core and being configured for engagement with a tape drive support, wherein the method comprises:

a) winding the tape onto the tape supply core to form a spool of tape, and b) placing the take up core within the internal volume of the tape supply core.

16. A method of packing a plurality of tape support arrangements, the method comprising producing the plurality of tape support arrangements in accordance with the method of claim 15, stacking the plurality of tape support arrangements in an end-to-end fashion, and packing the plurality of tape support arrangements so that they are contained within a packing tube.

17. The method according to claim 15, further comprising at least partly winding the tape around the take up core.

* * * * *